US011684153B2

(12) United States Patent
Leng

(10) Patent No.: US 11,684,153 B2
(45) Date of Patent: Jun. 27, 2023

(54) HOLLOW PANEL FURNITURE

(71) Applicant: NEW-TEC INTEGRATION (XIAMEN) CO., LTD., Fujian (CN)

(72) Inventor: Luhao Leng, Xiamen (CN)

(73) Assignee: NEW-TEC INTEGRATION (XIAMEN) CO., LTD., Xiamen (CN)

( * ) Notice: Subject to any disclaimer, the term of this patent is extended or adjusted under 35 U.S.C. 154(b) by 117 days.

(21) Appl. No.: 16/946,881

(22) Filed: Jul. 9, 2020

(65) Prior Publication Data

US 2020/0337452 A1 Oct. 29, 2020

Related U.S. Application Data

(62) Division of application No. 15/760,603, filed as application No. PCT/CN2016/098798 on Sep. 13, 2016, now Pat. No. 10,932,560.

(30) Foreign Application Priority Data

Sep. 16, 2015 (CN) ..... 201520717029.1

(51) Int. Cl.
*A47B 13/08* (2006.01)
*A47B 96/20* (2006.01)

(52) U.S. Cl.
CPC ..... *A47B 13/083* (2013.01); *A47B 13/08* (2013.01); *A47B 96/205* (2013.01); *A47B 2200/001* (2013.01)

(58) Field of Classification Search
CPC ..... A47B 13/08; A47B 13/083; A47B 96/205; A47B 2200/001
See application file for complete search history.

(56) References Cited

U.S. PATENT DOCUMENTS

| | | | |
|---|---|---|---|
| 1,979,309 | A | 11/1934 | Beiger |
| 2,739,640 | A | 3/1956 | Brinker et al. |
| 2,846,283 | A | 8/1958 | Pasewalk |
| 3,115,108 | A | 12/1963 | Craddock et al. |
| 3,439,634 | A | 4/1969 | Bender |
| 3,477,716 | A | 11/1969 | Bender |
| 3,676,279 | A | 7/1972 | Beaver |
| 5,271,338 | A | 12/1993 | Bonham et al. |

(Continued)

FOREIGN PATENT DOCUMENTS

| | | | |
|---|---|---|---|
| CN | 2517302 | Y * | 10/2002 |
| CN | 2517302 | Y | 10/2002 |

(Continued)

OTHER PUBLICATIONS

CN-2517302-Y Machine Translation (Year: 2002).*

(Continued)

*Primary Examiner* — Travis M Figg
(74) *Attorney, Agent, or Firm* — Perkins Coie LLP

(57) ABSTRACT

A hollow table top comprises a top plate and a bottom plate stacked together. The edge of the bottom surface of the table top is disposed with a metal frame. The edge of the top plate is disposed with a downwardly extending top plate side. The metal frame is disposed with a protruding portion in the horizontal direction extending out of the top plate side. The protruding portion protects the joint of the top plate and the bottom plate. The external edge of the table top has double-layer appearance.

12 Claims, 10 Drawing Sheets

(56) References Cited

U.S. PATENT DOCUMENTS

| | | | | |
|---|---|---|---|---|
| 5,303,824 | A | 4/1994 | Kohn | |
| 5,335,605 | A | 8/1994 | Drabczyk | |
| 5,357,872 | A | 10/1994 | Wilmore | |
| 5,461,989 | A | 10/1995 | Grandclement et al. | |
| 5,497,597 | A | 3/1996 | Elzenbeck | |
| 5,606,755 | A | 3/1997 | Romein | |
| 5,694,865 | A | 12/1997 | Raab | |
| 5,732,637 | A | 3/1998 | Raab | |
| 5,752,091 | A | 5/1998 | Kai et al. | |
| 5,835,661 | A | 11/1998 | Tai et al. | |
| 5,868,081 | A | 2/1999 | Raab | |
| 5,947,037 | A * | 9/1999 | Hornberger | A47B 13/02 108/115 |
| 6,058,853 | A | 5/2000 | Pinch | |
| 6,058,854 | A | 5/2000 | Tarnay et al. | |
| 6,371,034 | B1 | 4/2002 | Simpson et al. | |
| 6,666,152 | B2 | 12/2003 | Tsai | |
| 6,752,091 | B2 | 6/2004 | Glover et al. | |
| 6,817,662 | B2 | 11/2004 | Winter et al. | |
| 7,140,308 | B2 | 11/2006 | Tsai | |
| 7,475,643 | B2 | 1/2009 | Haney et al. | |
| 7,735,915 | B2 | 6/2010 | Nye et al. | |
| D668,483 | S | 10/2012 | Bennett | |
| 8,387,544 | B1 | 3/2013 | Lee | |
| 9,504,314 | B2 | 11/2016 | Leng | |
| 9,808,081 | B2 | 11/2017 | Leng | |
| 9,867,458 | B2 | 1/2018 | Leng | |
| 10,092,091 | B1 | 10/2018 | Wang et al. | |
| 10,206,497 | B2 | 2/2019 | Leng | |
| 10,932,560 | B2 | 3/2021 | Leng | |
| 2003/0183135 | A1 | 10/2003 | Tsai | |
| 2003/0200904 | A1 | 10/2003 | Strong | |
| 2003/0213414 | A1 | 11/2003 | Strong | |
| 2003/0213416 | A1 | 11/2003 | Strong et al. | |
| 2003/0230219 | A1 | 12/2003 | Strong et al. | |
| 2004/0187744 | A1 | 9/2004 | Wang | |
| 2005/0274306 | A1 | 12/2005 | Strong | |
| 2005/0284562 | A1 | 12/2005 | Frantz et al. | |
| 2008/0092788 | A1 | 4/2008 | Leng | |
| 2008/0098936 | A1 | 5/2008 | Strong | |
| 2008/0264307 | A1 | 10/2008 | Vannimwegen et al. | |
| 2008/0265307 | A1 | 10/2008 | Lee | |
| 2009/0324872 | A1 * | 12/2009 | Leng | B32B 3/12 428/73 |
| 2010/0043681 | A1 * | 2/2010 | Leng | A47B 13/086 108/193 |
| 2010/0112265 | A1 | 5/2010 | Leng | |
| 2010/0310811 | A1 | 12/2010 | Leng | |
| 2011/0174197 | A1 | 7/2011 | Seger | |
| 2011/0203493 | A1 | 8/2011 | Ashby et al. | |
| 2013/0025508 | A1 | 1/2013 | Leng | |
| 2014/0037910 | A1 | 2/2014 | Leng | |
| 2016/0051049 | A1 | 2/2016 | Peery et al. | |
| 2016/0066684 | A1 | 3/2016 | Leng et al. | |
| 2018/0064242 | A1 | 3/2018 | Tsai | |
| 2020/0022490 | A1 | 1/2020 | Leng | |
| 2020/0275780 | A1 | 9/2020 | Leng | |

FOREIGN PATENT DOCUMENTS

| | | | | |
|---|---|---|---|---|
| CN | 2829461 | Y | 10/2006 | |
| CN | 201299266 | Y * | 9/2009 | A47B 3/0911 |
| CN | 201299266 | Y | 9/2009 | |
| CN | 202222701 | U | 5/2012 | |
| CN | 103239011 | A | 8/2013 | |
| CN | 103284471 | A | 9/2013 | |
| CN | 205093820 | U | 3/2016 | |
| CN | 207657291 | U | 7/2018 | |
| JP | 2982712 | B2 | 9/1999 | |
| WO | 2017045579 | A1 | 3/2017 | |

OTHER PUBLICATIONS

CN-201299266-Y Machine Translation (Year: 2009).*
Machine Translation of CN2829461 Y (Year: 2020).
CNIPA, International Search Report and Written Opinion, for PCT/CN2019/101382, dated Nov. 19, 2019, with English translation, 14 pgs.
Extended European Search Report dated Feb. 21, 2019 for Application No. 1685693.7, 6 pages.
State Intellectual Property Office, PRC China, International Search Report for International Application No. PCT/CN2016/098798 dated Oct. 28, 2016, 16 pages.

* cited by examiner

HOLLOW PANEL FURNITURE

This application is a Division of U.S. application Ser. No. 15/760,603 filed Aug. 28, 2018 and now pending, which is a 371 of PCT/CN2016/098798 filed Sep. 13, 2016 claiming priority to Chinese Application No. 201520717029 filed Sep. 16, 2015. These applications are incorporated herein by reference.

BACKGROUND OF THE INVENTION

A known plastic table top has a single thick plate or two layers of thin plates. These table tops are blow molding types and vacuum forming types. These hollow table tops have a top plate and a bottom plate stacked together. A metal frame is disposed at the inner side of the periphery of the stacked top plate and the bottom plate. Existing vacuum forming table tops need vertical flanges at the inner side of the periphery of the top and bottom plate to cover the metal frame. The joint of the top plate and the bottom plate is exposed. In use fingers or clothes may be caught or clamped by the vertical flanges, causing injury or damaging clothes or the vertical flanges. This kind of embedded metal frame only acts to increase strength and connect the support elements but it cannot protect the connecting points of the top plate and the bottom plate.

SUMMARY OF THE INVENTION

A frame structure of a table top with stable structure and high security overcomes the disadvantages of the related art. A hollow table top has a top plate and a bottom plate, the bottom plate is disposed with projections or concave features. The edge of the bottom surface of the table top is disposed with a metal frame, the edge of the top plate extends downwardly. The metal frame is disposed with a protruding portion in the horizontal direction extending out of the top plate side.

In another preferred embodiment, the protruding portion of the metal frame is a crimping bending upwardly and covers the bottom portion of top plate side.

In another preferred embodiment, the protruding portion of the metal frame is closed to the bottom portion of the top plate side. In another preferred embodiment, the bottom portion of the top plate side bends towards the metal frame. The side surface of the hollow table top is substantially a plane.

In another preferred embodiment, the edge of the bottom plate is disposed with a downwardly extending bottom plate side. The crimping covers the bottom portion of the bottom plate side. In another preferred embodiment, the bottom portion of the bottom plate side bends towards the metal frame.

In another preferred embodiment, the bottom portion of the bottom plate is disposed with a downwardly extending fixing portion. The fixing portion is disposed at the side of the top plate side opposite to the metal frame. A screw laterally passes through the fixing portion to lock to the metal frame.

Compared to the existing known technology, advantages are:

1. The external side of the metal frame extends out of the top plate side, and covers the bottom portion of the top plate side or abuts against the bottom portion of the top plate side. When being used, the bottom portion of the top plate is not folded up, improving the integration of the table top. Fingers or clothes are not clamped by the vertical flange. At the same time, the crimping covers the top plate side.

2. The metal frame is detachably locked to the bottom plate, the structure is simple and more stable.

DETAILED DESCRIPTION OF THE EMBODIMENTS

The First Embodiment

Figure 1:
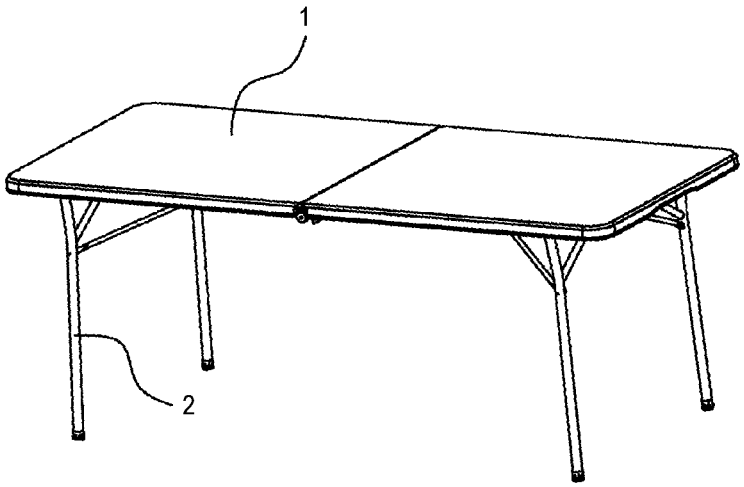
FIG. 1 illustrates a schematic diagram of a table.
Figure 2:
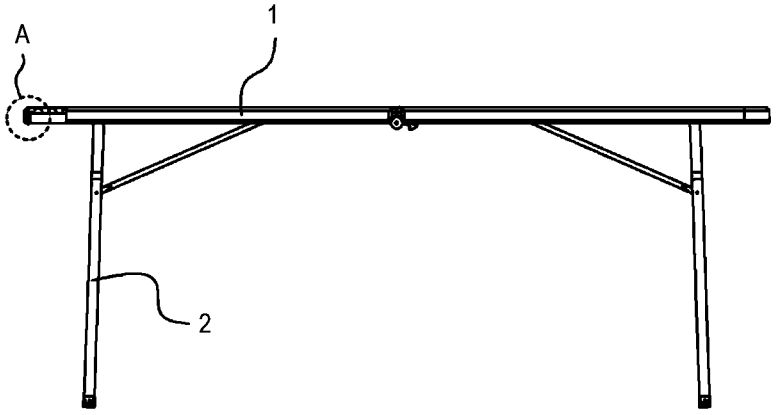
FIG. 2 illustrates a front view of the table of FIG. 1.
Figure 3:
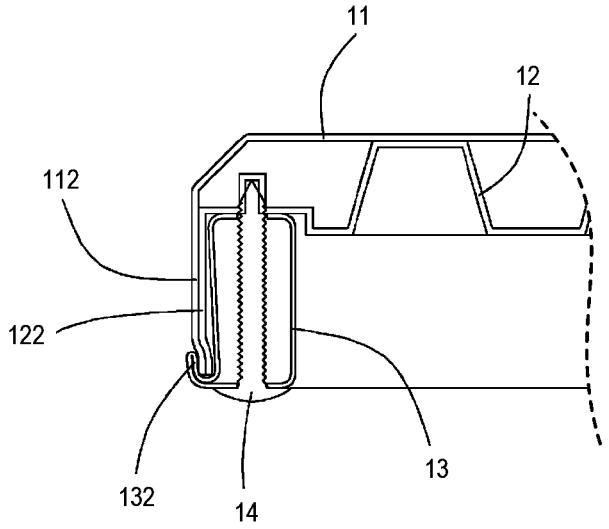
FIG. 3 illustrates an enlargement diagram of area A of FIG. 2.

Referring to FIG. 1, FIG. 2 and FIG. 3, the table comprises a table top 1 and table legs 2. The table legs 2 are foldable and connected to the bottom of the table top 1. The table top 1 comprises a top plate 11 and a bottom plate 12 being stackable together. The bottom plate 12 has concave features or projections 121. The edge of the bottom surface of the top plate 1 is disposed with a metal frame 13. The bottom plate 12 is supported on the metal frame 13. The metal frame 13 is detachably locked to the bottom plate 12. A screw 14 passes through the metal frame 13 to lock to the bottom plate 12 from end up.

The edge of the top plate 11 is disposed with a downwardly extending top plate side 112. The bottom portion of the top plate side 112 bends towards the metal frame 13. The edge of the bottom plate 12 is disposed with a downwardly extending bottom plate side 12. The bottom portion of the bottom plate side 122 bends towards the metal frame 13. The top plate side 112 and the bottom plate side 122 are contacted together. The metal frame 13 has a protruding portion, which, in this embodiment is a crimping 132 bending upwardly from the bottom portion of the top plate side 112. The crimping 132 covers the bottom portion of the top plate side 112 and the bottom plate side 122.

The bottom portion of the top plate side and the bottom plate side bend towards the metal frame so as to make space for the crimping and keep the crimping and the external edge of the crimping vertically aligned, so the side surface is in a plane and the table top attractive.

The Second Embodiment

Figure 4:
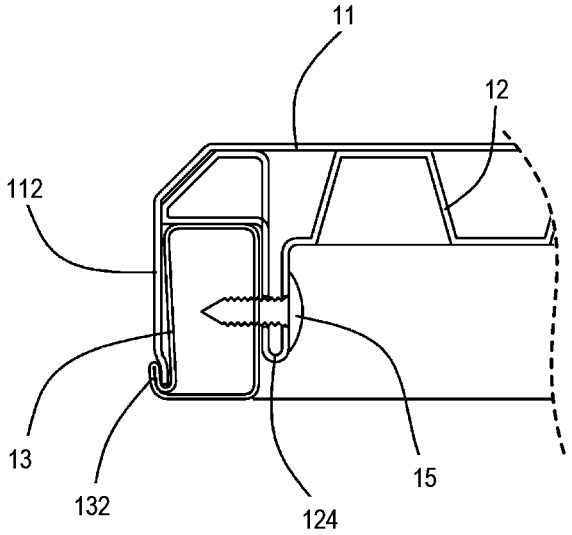
FIG. 4 illustrates a schematic diagram of a frame of another table top.

Referring to FIG. 4, the second embodiment differs from the first embodiment in that: the edge of the bottom plate 12 does not have a bottom plate side and the crimping 132 only covers the top plate side 112. The bottom portion of the bottom plate 12 extends down with a fixing portion 124, which is disposed at the side of the metal frame 13 opposite to the top plate side 112. A screw 15 laterally passes through the fixing portion 124 to lock to the metal frame 13.

The Third Embodiment

Figure 5:
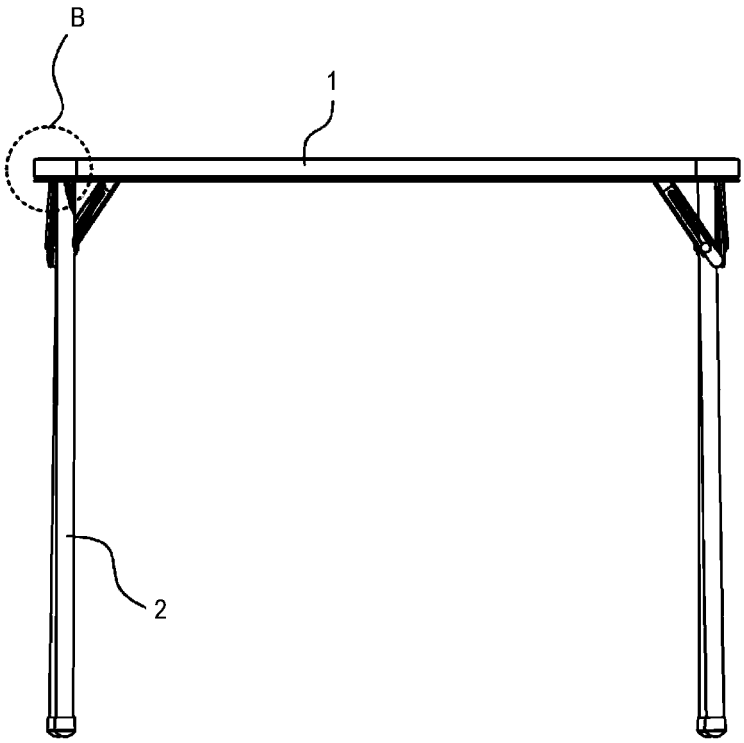
FIG. 5 illustrates a schematic diagram of a table of a third embodiment.
Figure 6:
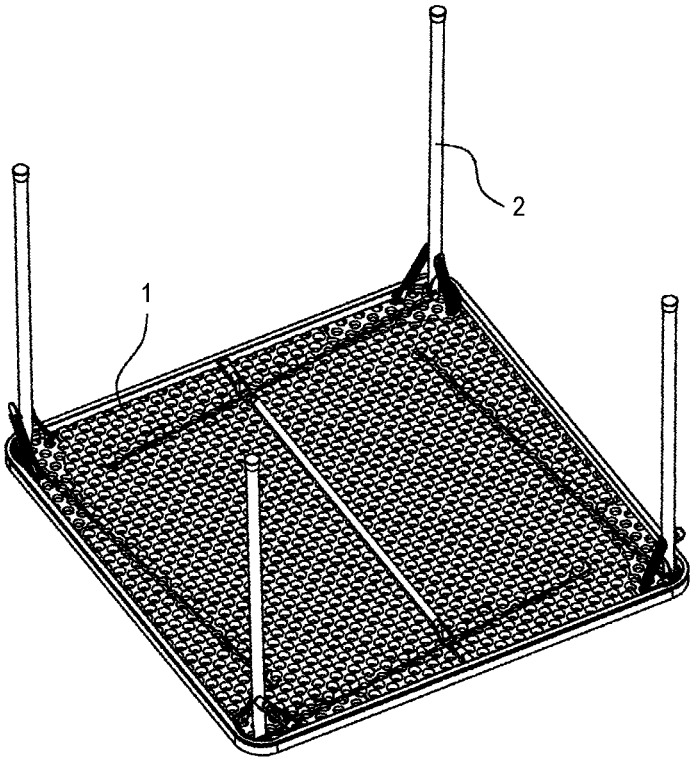
FIG. 6 illustrates a schematic diagram of the bottom portion of the table of the third embodiment.
Figure 7:
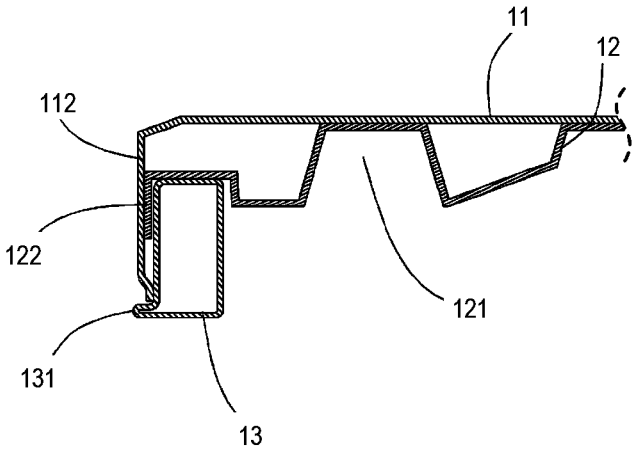
FIG. 7 illustrates an enlargement diagram of B of FIG. 5.

Referring to FIG. 5, FIG. 6 and FIG. 7, the table of this embodiment is a square table comprising a table top 1 and table legs 2. The table legs 2 are foldable and connected to the bottom portion of the table top 1. The table top 1 comprises a top plate 11 and a bottom plate 12 being stackable together. The bottom plate has projections or concave features 121. The edge of the bottom surface of the table top 1 is disposed with a metal frame 13, which supports on the bottom plate 12. The metal frame 13 is locked to the bottom plate 12. A screw 14 (not shown) passes through the metal frame 13 to lock to the bottom plate 12 from end up.

The edge of the top plate 11 is disposed with a downwardly extending top plate side 112. The edge of the bottom plate 12 is disposed with a downwardly extending bottom plate side 122. The top plate side 112 and the bottom plate side 122 are in contact and attached together. The metal frame 13 is disposed with a protruding portion 131, which is a substantially lateral straight edge at the bottom portion of the metal frame. The bottom portion of the top plate side 112 ends at the protruding portion 131 of the metal frame.

The Fourth Embodiment

Figure 8:
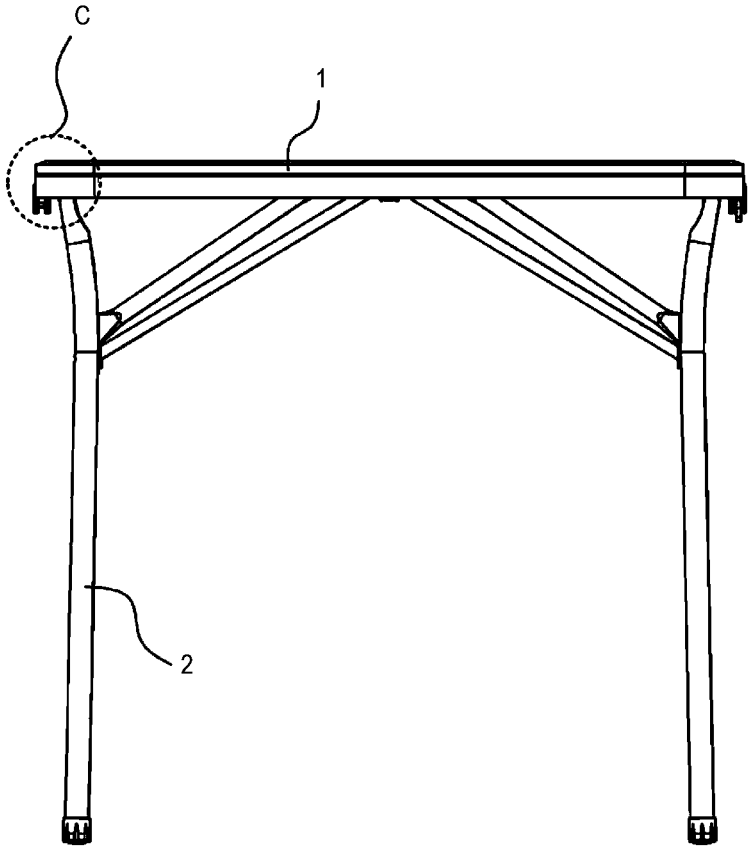
FIG. 8 illustrates a front view of a table of a fourth embodiment.
Figure 9:
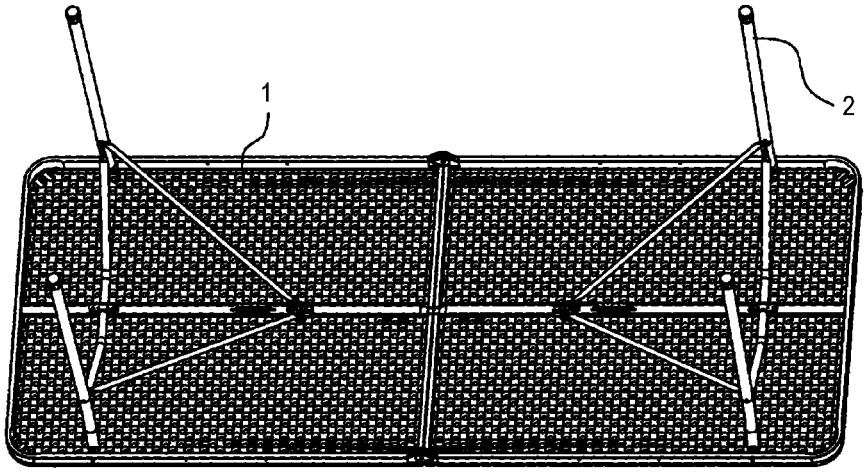
FIG. 9 illustrates a schematic diagram of the bottom portion of the fourth embodiment.
Figure 10:
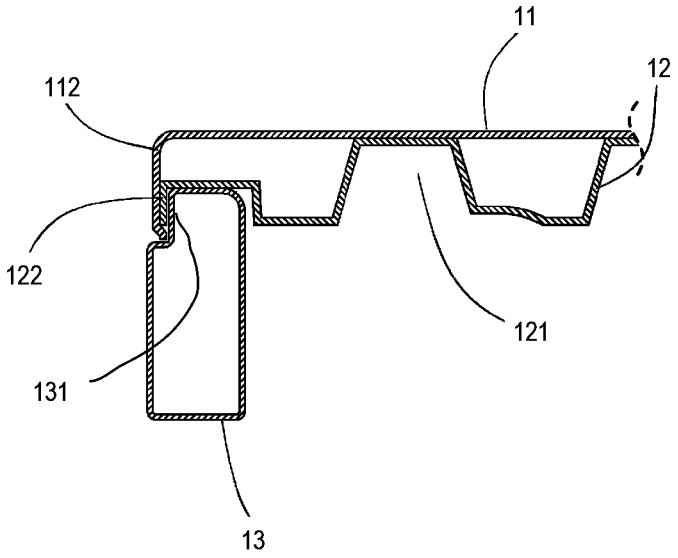
FIG. 10 illustrates an enlargement diagram of C of FIG. 8.

Referring to FIG. 8, FIG. 9 and FIG. 10, the table of this embodiment is a long table with a foldable table top, the table comprises a table top 1 and table legs 2. The table legs 2 are foldable and connected to the bottom portion of the table top 1. The table top 1 comprises a top plate 11 and a bottom plate 12 being stackable together. The bottom plate has projections or concave features 121. The edge of the bottom surface of the table top 1 is disposed with a metal frame 13, which supports on the bottom plate 12. The metal frame 13 is locked to the bottom plate 12.

The edge of the top plate 11 is disposed with a downwardly extending top plate side 112. The top plate side 112 and the bottom plate side 122 are in contact and attached together. The metal frame 13 is disposed with a protruding portion 133. The bottom portion of the top plate side 112 ends at the protruding portion 133 of the metal frame.

Although the present invention has been described with reference to the preferred embodiments thereof for carrying out the patent for invention, it is apparent to those skilled in the art that a variety of modifications and changes may be made without departing from the scope of the invention which is defined by the appended claims.

The invention claimed is:

1. Furniture comprising:

a top plate having a flat inner section having first, second, third and fourth sides;

first, second, third and fourth top plate sides at the first, second, third and fourth sides of the inner section, respectively;

a bottom plate attached to the top plate;

first, second, third and fourth hollow frame tubes at the first, second, third and fourth sides of the top plate, respectively, each hollow frame tube having a lower portion having a first width and an upper portion having a second width less than the first width;

the upper portion of each hollow frame tube attached to the bottom plate;

the upper portion of the first hollow frame tube having an outer wall inwardly offset from an outer wall of the lower portion of the first hollow frame tube, providing an outward-facing recess at the top of the first hollow frame tube; and a first bottom plate side at a first side of the bottom plate, wherein a lower portion of the first top plate side and the first bottom plate side are in the outward-facing recess.

2. The furniture of claim 1 wherein the outward-facing recess is formed only by one vertical surface of the outer wall of the upper portion perpendicularly adjoining a horizontal surface of the outer wall of the upper portion.

3. The furniture of claim 1 wherein the first bottom plate side is between the first top plate side and the upper portion of the first hollow frame tube.

4. The furniture of claim 1 wherein the lower portion of the first top plate side includes an inward joggle above the outward-facing recess.

5. The furniture of claim 4 wherein the first top plate side has a lower edge vertically below the first bottom plate side.

6. The furniture of claim 1 wherein the outer wall of the first hollow frame tube is flat and the first hollow frame tube has a flat inner wall parallel to the outer wall, and a flat bottom wall joined to and perpendicular to, the inner wall and the outer wall.

7. The furniture of claim 1 wherein the upper portion of the first hollow frame tube is attached to a horizontal outer perimeter section the bottom plate.

8. The furniture of claim 1 further including one or more fasteners attaching the hollow frame tubes to the bottom plate.

9. The furniture of claim 1 wherein the lower portion of each hollow frame tube and has a first width and a first length, and the upper portion of each hollow frame tube has a second width less than the first width, and a second length less than the first length.

10. The furniture of claim 1 wherein a lower portion of the first top plate side is parallel to and in contact with the first bottom plate side, and the first bottom plate side is in contact with and parallel to an outer wall of the upper portion of the first hollow frame tube.

11. The furniture of claim 1 wherein each hollow frame tube has a flat outer wall parallel to and offset to an outer side of one of the top plate sides.

12. Furniture comprising:

a top plate having a flat inner section having first, second, third and fourth sides;

first, second, third and fourth top plate sides at the first, second, third and fourth sides of the inner section, respectively, the top plate sides perpendicular to the flat inner section;

a bottom plate attached to the top plate, the bottom plate having first, second, third and fourth bottom plate sides alongside of an upper portion of first, second, third and fourth hollow frame tubes, respectively, each hollow frame tube having a lower portion having a width less than the upper portion;

the upper portion of each hollow frame tube attached to the bottom plate;

the upper portion of the each hollow frame tube having an outer wall inwardly offset from an outer wall of the lower portion, providing an outward-facing recess at the top of each hollow frame tube;

a lower portion of the first, second, third and fourth top plate sides and the first, second, third and fourth bottom plate sides in the outward-facing recess; and the first, second, third and fourth bottom plate sides between the first, second, third and fourth top plate sides and the upper portion of the first, second, third and fourth hollow frame tubes, respectively.

* * * * *